US007818938B2

(12) United States Patent
Lemieux

(10) Patent No.: US 7,818,938 B2
(45) Date of Patent: Oct. 26, 2010

(54) BLOCK AND CONNECTOR SYSTEM

(76) Inventor: Guy Lemieux, 742, chemin St-Louis, Amherst, QC (CA) J0T 2L0

( * ) Notice: Subject to any disclaimer, the term of this patent is extended or adjusted under 35 U.S.C. 154(b) by 81 days.

(21) Appl. No.: 12/010,908

(22) Filed: Jan. 31, 2008

(65) Prior Publication Data

US 2008/0307745 A1 Dec. 18, 2008

(30) Foreign Application Priority Data

Feb. 2, 2007 (CA) ..... 2577424

(51) Int. Cl.
*E04B 1/02* (2006.01)

(52) U.S. Cl. ..... 52/564; 52/562

(58) Field of Classification Search ..... 52/245, 52/283, 284, 272, 309.1, 309.13, 309.16, 52/309.8, 309.9, 505, 561, 562, 563, 566, 52/569, 596, 605, 606, 608; 403/6, 7, 8, 403/327; 446/115, 120, 121

See application file for complete search history.

(56) References Cited

U.S. PATENT DOCUMENTS 2,530,940 A * 11/1950 Dahlin ..... 454/185
4,075,808 A * 2/1978 Pearlman ..... 52/439
4,110,949 A * 9/1978 Cambiuzzi et al. ..... 52/437
4,597,236 A * 7/1986 Braxton ..... 52/564
5,704,177 A * 1/1998 Wirkus et al. ..... 52/308
6,485,329 B2 * 11/2002 Eppe et al. ..... 439/570
6,736,691 B1 * 5/2004 Bach ..... 446/128
6,843,034 B2 * 1/2005 McDonald ..... 52/564
6,857,240 B1 * 2/2005 MacAlister ..... 52/564
6,993,878 B2 * 2/2006 Prokofyev ..... 52/604
7,191,571 B2 * 3/2007 Schools et al. ..... 52/607
2006/0059839 A1 * 3/2006 Azar ..... 52/606
2006/0236645 A1 * 10/2006 Holt ..... 52/715

* cited by examiner

*Primary Examiner*—Brian E Glessner
*Assistant Examiner*—Adam Barlow
(74) *Attorney, Agent, or Firm*—Equinox Protection; Franz Bonsang, Patent Agent

(57) ABSTRACT

The present invention is concerned with a building system comprising i) at least first and second hollow blocks each having at least one side wall, and at least two end walls extending in at least one common direction, at least one of the walls in each block having a given thickness and being provided with a first cut-out extending throughout said wall thickness at a first free end of said wall, and ii) at least one connector element defining a cylindrical hollow body having a shape and size conforming with a perimeter corresponding to a juxtaposition of said first and second cut-outs for snug engagement within the perimeter, and at least one first flange projecting from a first end of the body and at least one second flange projecting from a second end of the body, said first and second flanges defining an intermediate spacing substantially equal to twice the value of said thickness. Thereby, the first block can be connected to the second block for erecting structures by registering cut-outs of adjacent walls against each other and connecting said adjacent walls together by snugly positioning the connector element in the cut-outs with first and second flanges abutting respectively on inner faces of each of the adjacent walls.

20 Claims, 5 Drawing Sheets

BLOCK AND CONNECTOR SYSTEM

FIELD OF THE INVENTION

The present invention generally relates to blocks systems for construction and more specifically to blocks and connectors systems for building structures without requiring a wet assembly medium such as mortar or concrete.

BACKGROUND OF THE INVENTION

It is known to provide block systems for the erection of structures such as building walls. Traditionally, structures have been erected by laying superimposed horizontal courses of vertically interlocked simple parallelepipedic hollow concrete blocks, assembled using mortar to connect and seal all joints, thereby providing mechanical and structural properties acceptable in many cases without requiring complex forms and pouring of liquid concrete as needed to erect solid concrete structures. In an attempt to further reduce building costs and accelerate erection time, mortar-less composite interlocking block systems have been proposed in the prior art for enabling dry assembly of block structures, yet contemplating appropriate properties for applications such as in building construction and landscaping. However, such systems are very seldom used in practice for building walls, due to many limitations. Namely, providing appropriate mechanical connections requires the superimposed blocks to be positively locked with each other in order to prevent relative movement in the axial and transversal orientation of the courses. Therefore, many complex interlocking block structures incorporating connection members have been proposed. However, such blocks must be manufactured with tight tolerances and be handled with much care to enable proper block interconnection on the construction site. Still, cement and aggregate based composite materials such as concrete being non compliant and brittle, it is difficult to achieve a stiff and tight fit at block joints even with slight dimensional mismatches or damages. In some cases, separate connectors are used to assist or improve block interconnection.

Another desirable feature for block systems used for building walls is to provide continuous passages inside the walls. While vertical passages are commonly available using most types of hollow building blocks, it is also very desirable to provide openings in the end walls and inner cross members of hollow blocks to define continuous longitudinal passages inside the walls when blocks are laid down in parallel courses. Such passages may be used to pass reinforcing metal rods and pour liquid reinforcing concrete, or to inject or install insulating material such as polyurethane foam, or to run services such as plumbing pipes or electrical or communication wiring or cables from points to points using connecting vertical and horizontal passages.

Accordingly, some solutions have been provided in the prior art which include interconnecting block systems providing different types of integral or separate connecting/locking means, some of these systems also forming longitudinal passages in the erected walls. However, these are not found on the market given their generally poor overall performance and high manufacturing cost.

In U.S. Pat. No. 4,075,808 entitled "Building Construction System Using Mortar-less Modular Building Block Elements" granted to Pearlman on Feb. 28, 1978, hollow interlocking building blocks are provided with a complex structure which enables locking of adjoining superimposed blocks in the axial and transversal horizontal directions. The block structure further provides integrally formed vertically directed recesses and cut-out portions at each lateral end of the blocks for providing communicating vertical and horizontal passages once the wall has been erected. Liquid cement can be poured to form a reinforcing lattice filling passages. The system includes regular blocks, corner blocks, wall end blocks and interior wall connecting blocks. An important limitation of that system is that due to the complex structure of the blocks, block major walls must be thick to provide sufficient mechanical resistance to the brittle free ends and corners, so that for erecting a wall of a given thickness, more block material must be used and less passage space will be available. Therefore, material costs are increased as well as thermal conductivity, and passages would be hard to access from the block surface and would allow very limited space for the passage of services. Also, using non-compliant concrete elements to interconnect blocks limits stiffness and tightness of the assembly and is not well adapted for erecting structures without using stabilizing liquid cement.

U.S. Pat. No. 5,862,640, issued to Negri in January 1999, also teaches hollow building blocks to be placed in direct contact on top and next to one another, where vertical and horizontal voids are provided to enable passage of an interconnected web of vertical and horizontal steel reinforced concrete beams. Although it has a less complex and less damage sensitive structure than that of U.S. Pat. No. 4,075,808, this system for building blast bomb resistant walls does not provide locking or interconnecting means that would prevent axial displacement of the blocks if no added reinforcements were used as intended.

International patent application No WO 94/00648 by Scheiwiller (published on Jan. 6, 1994) and entitled "Set of Building Blocks", discloses a set of building blocks consisting of a basic block, two end blocks of different length and an optional joint block designed to be laid in a line to build straight or angled walls. The system may also comprise an optional connecting block cooperating with recesses and projections into the building blocks to positively lock them together. However, connecting blocks are solid blocks which prevent continuous longitudinal passages to be formed when a wall is so erected.

European patent application No 0190076 by Cruaud (published on May 2, 1990) and entitled "Bloc de construction et organe de liaison positive associés", also provides building blocks and a separate connecting element to provide positive lock in the two horizontal orientations of blocks superimposed and vertically interlocked in courses to form walls. Connecting elements comprise an outer rim which cooperates with recesses and cut-outs in the blocks and can have their centre wall punctured so to define horizontal passages in the erected wall. Still, block structure is complex, making molding delicate and costly, and making the brittle concrete block fragile and subject to damages during handling and installation. In addition, narrow recesses may be partly filled with debris on a construction site, which might prevent proper fit of connecting elements.

Therefore, it is desired to overcome or reduce at least some of the above-described problems.

SUMMARY OF THE INVENTION

The present invention reduces the limitations, difficulties and disadvantages of the aforesaid designs by providing a block and connector system for erecting structures such as building walls, which can be assembled providing positive lock of the blocks and vertical and horizontal passages adapted to many uses. As the block is a simple construction it is easy to manufacture with low manufacturing costs, and is not likely to be damaged or otherwise adversely affected by handling and construction site conditions. The Applicant has found the surprising discovery that such a spool-like connecting element co-operating with simple cut-outs at the free ends of upright walls of adjacent blocks overcomes the problems associated with the aforesaid designs. As the connecting element may be formed of a compliant or resilient material, a stiff and tight assembly can be easily and accurately performed without requiring excessive block molding tolerances and handling care. It will be appreciated that the embodiments according to the present invention obviate the limitations and drawbacks of the prior art blocks and systems, namely by improving block resistance to damages and thermal conductivity, stiffness of the assembly and in-wall channeling, while reducing weight and production costs, thus enabling convenient use in a wide range of applications.

In a broad sense, the present invention concerns a building system comprising i) a hollow block having at least one side wall, two end walls extending in a common direction, at least one of the walls having a given thickness and being provided with a first cut-out extending through said thickness from a first free end of said wall and a second symmetrical cut-out extending through said thickness from a second opposite free end of said wall, and ii) a connecting element defining a cylindrical hollow body having a shape and size mating with the cut-outs for snug engagement therewith, and at least one first flange projecting upwardly and downwardly from a first end of the body and a at least one second flange projecting upwardly and downwardly from a second end of the body, said first and second flanges defining an intermediate spacing substantially equal to twice the value of said thickness, whereby the block can be connected to another adjacent block for erecting structures such as walls, by registering cut-outs of adjacent walls against each other and connecting said adjacent walls together by snugly positioning the connector element in the cut-outs with first and second flanges abutting respectively on inner faces of each of the adjacent walls.

A second cut-out may be provided at a second opposite free end of the at least one end wall. Cut-outs may further be provided at one or both free ends of other walls of the block.

Cut-outs may define a semi-circular or rectangular opening through a wall. Accordingly, the body of the connector element may have a circular or rectangular or square cross section. The body of the connector element may have a circular cross section and the first and second flanges may have the shape of a ring centered with the axis of the body and orthogonal to said axis, defining an axial hole through the connector.

Connector body may have a rectangular or square cross section and flanges defining a H shaped longitudinal cross section may comprise distinct upper and lower flanges. Flanges may be slightly tilted to provide a spacing therebetween tapering toward the body.

The connector may be made from a compliant material. The connector may be made from a resilient thermoplastic material. The connector may be made from polypropylene, polyethylene or ABS.

The block may comprise two parallel end walls with free ends, each wall being provided with a cut-out at at least one free end thereof.

The block may comprise two parallel end walls and two parallel side walls twice the length of end walls forming a rectangular parallelepiped. Both end walls may be provided with cut-outs at both of their free ends. The block may further comprise a centre cross member extending parallel to the end walls and having twice the thickness of the end walls, said cross member defining two opposite free ends and being provided with a cut-out at one or both free ends thereof. The block may have a height equal to the length of the end walls. The block may have a height of 12 inches, an end wall length of 12 inches and a side wall length of 24 inches.

The block may comprise two parallel end walls and two parallel side walls twice the length of end walls forming a rectangular parallelepiped and further comprising an inner cross member parallel to the end walls, a cut-out being provided at both free ends of one of the end walls, at both free ends of the cross member and at both free ends of one of the side walls, to provide a end block. The block may further be provided with a pair of cut-outs on the second side wall, facing those of the other side wall to provide a T end block. The block may still further be provided with a cut-out at both free ends of the other end wall to form a crossing or X block.

The block may comprise two parallel end walls and two parallel side walls of equal length defining a hollow cube, one end wall being provided with cut-outs at both of their free ends to form a half end block.

In an alternative embodiment, the block comprises two concentric arc shaped side walls, two radially extending side walls and a radially extending center cross member.

In a further alternative embodiment, the block comprises one arc shaped side wall, two intersecting radially extending side walls and a radially extending center cross member.

According to another aspect of the invention, the block is provided with sealing upright edges. The block may further be provided with longitudinal sealing edges.

Advantageously, the invention provides a building block and connector system featuring stiff and tight interconnections between blocks in the axial and transversal directions of the courses, while providing vertical and horizontal passages within the erected structure. The block structure limits thermal conductivity, may be produced at low cost and is not likely to be affected by rough handling and adverse site conditions.

BRIEF DESCRIPTION OF THE DRAWINGS

Further aspects and advantages of the present invention will become better understood with reference to the description in association with the following figures. Note that similar numerals represent similar parts throughout figures.

FIG. 3 (*b*) is cross-sectional view from line B-B of the connector of FIG. 3(*a*);

FIG. 3 (*c*) is side view of a connector according to another embodiment of the system of the invention;

FIG. 3 (*d*) is a perspective view of a connector according to another embodiment of the system of the invention;

FIG. 3 (*e*) is a perspective view of a connector according to another embodiment of the system of the invention;

FIG. 4(*b*) is a schematic perspective view of a T end block according to an embodiment of the system of the invention;

FIG. 4(*c*) is a schematic perspective view of a crossing (X) block according to an embodiment of the system of the invention;

FIG. 4(*d*) is a schematic perspective view of a full length blind end block according to an embodiment of the system of the invention;

FIG. 4(*e*) is a schematic perspective view of a half length blind end block according to an embodiment of the system of the invention;

FIG. 5 (*b*) is perspective view of a decorative block according to an embodiment of the system of the invention;

FIG. 5 (*c*) is top plan view of a three side curved block according to an embodiment of the system of the invention.

FIG. 5 (*d*) is top plan view of a further embodiment the block of the system of the invention, wherein special joint sealing edges are provided.

DETAILED DESCRIPTION OF THE INVENTION

Although the present invention will be described with reference to embodiments mainly adapted for erecting structures such as building wall, persons skilled in the art will appreciate other applications of the present invention wherein variations in the shape of the block may be desirable. For example, external shapes and textures of the blocks may be adapted for use in erecting structures in landscaping, or size and material may be adapted for use as a toy building block system.

Figure 1:
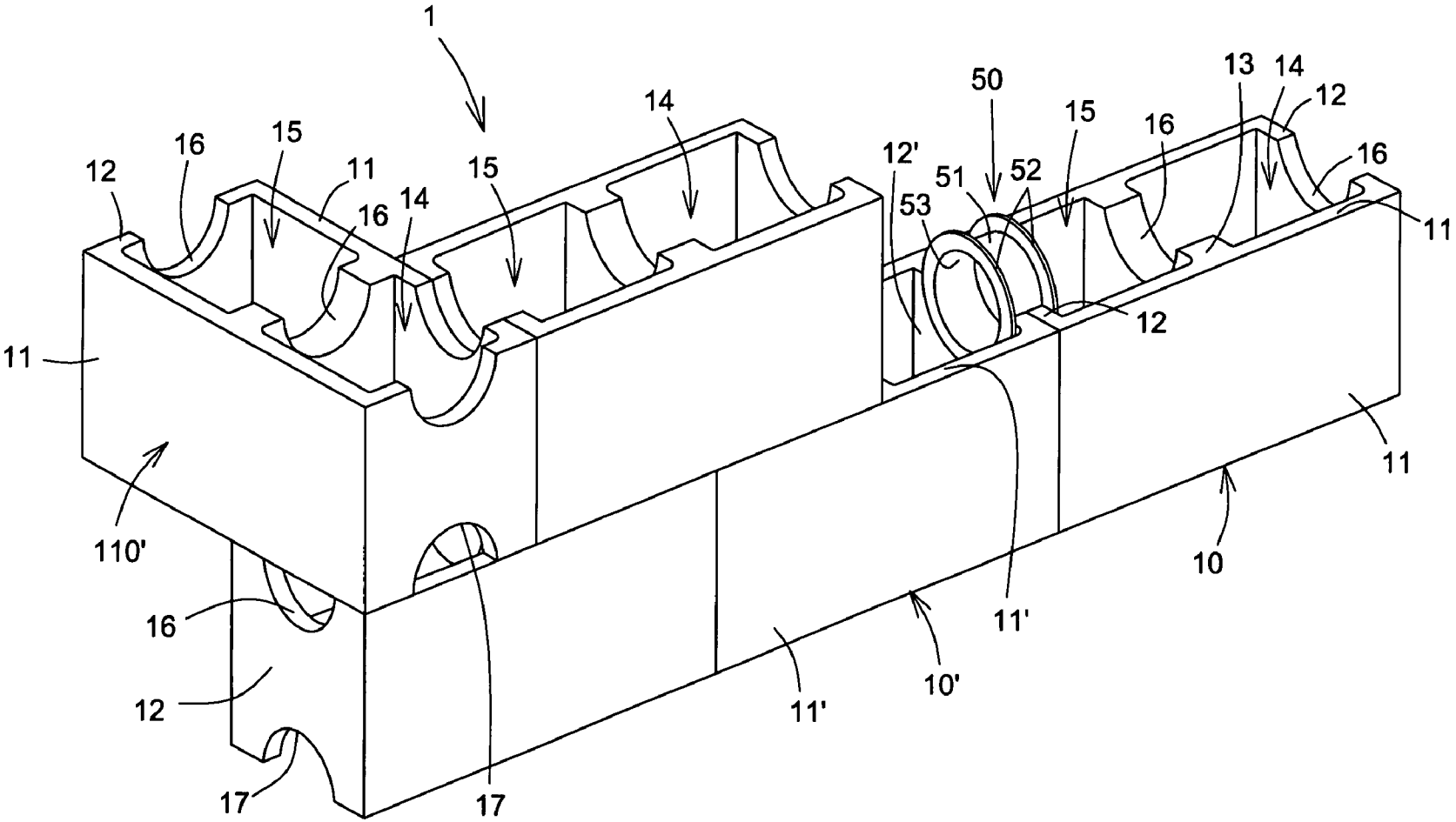
FIG. 1 is a perspective view of a wall portion assembled using elements of a block and connector system, according to an embodiment of the present invention.

FIG. 1 shows a portion of a structure erected using a block and connector system 1 according to the present invention. The illustrated system 1 comprises hollow building blocks such as regular block 10 and special intersecting corner block 110', and connectors such as spool-like connector 50.

Figure 2:
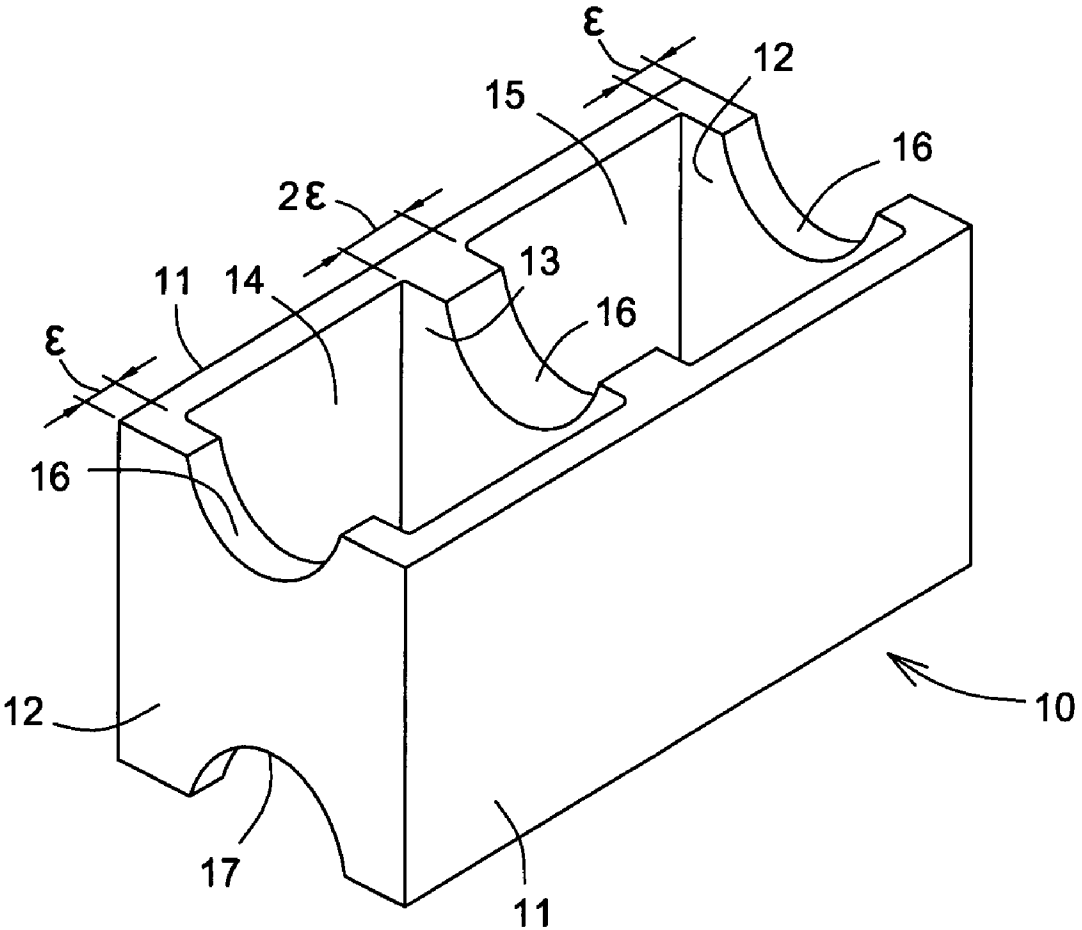
FIG. 2 is an enlarged perspective view of a regular building block of the system of FIG. 1.
Figure 3A:
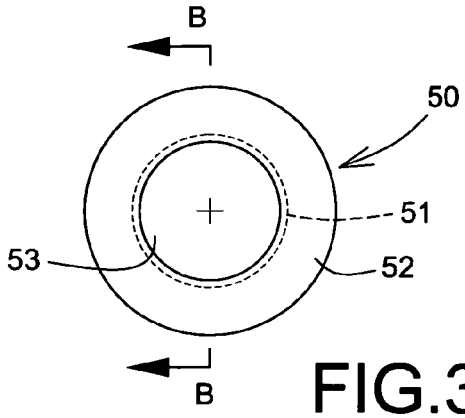
FIG. 3 (*a*) is a side view of the connector element (connector) of the system of FIG. 1.
Figure 3B:
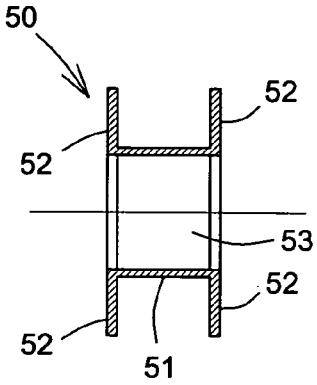
Figure 3C:
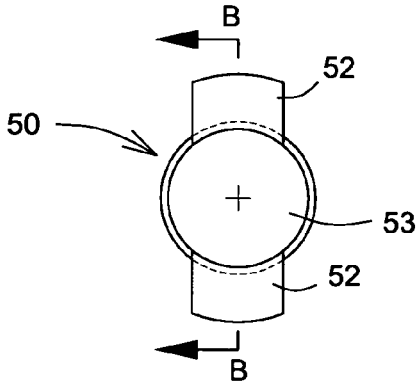
Figure 3D:
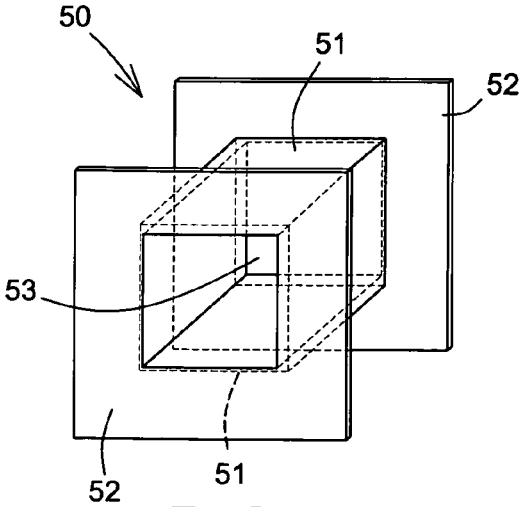
Figure 3E:
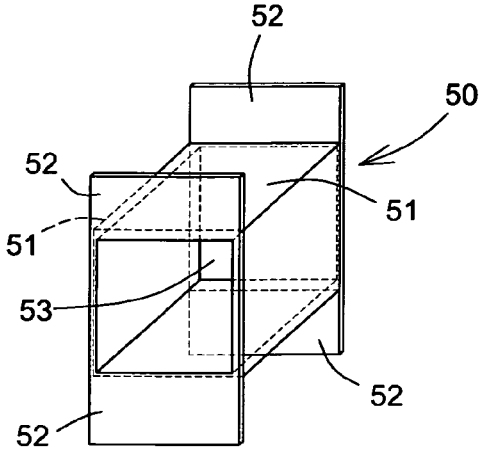
Figure 4A:
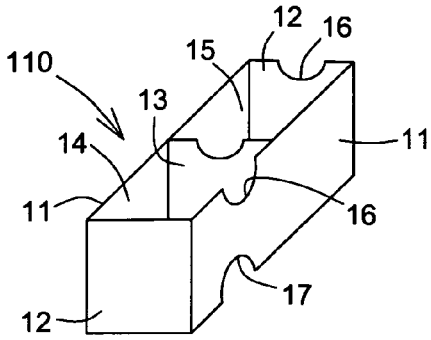
FIG. 4(*a*) is a schematic perspective view of a corner block according to an embodiment of the system of the invention.
Figure 4B:
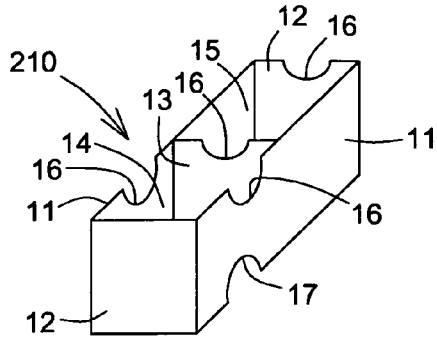
Figure 4C:
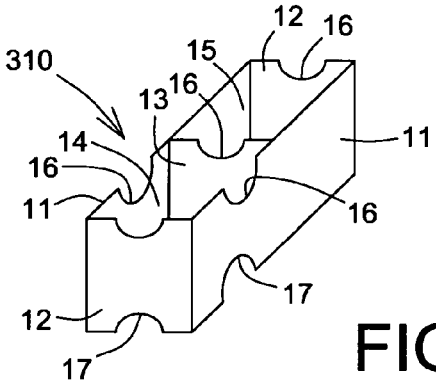
Figure 4D:
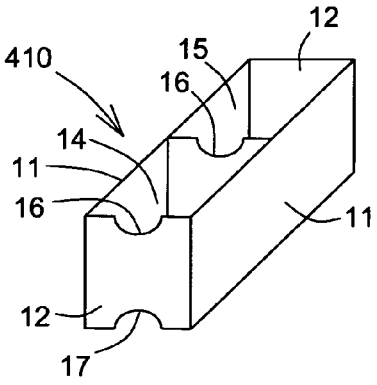
Figure 4E:
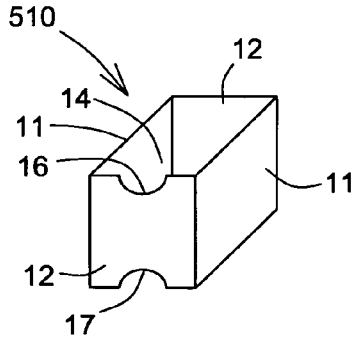
Figure 5A:
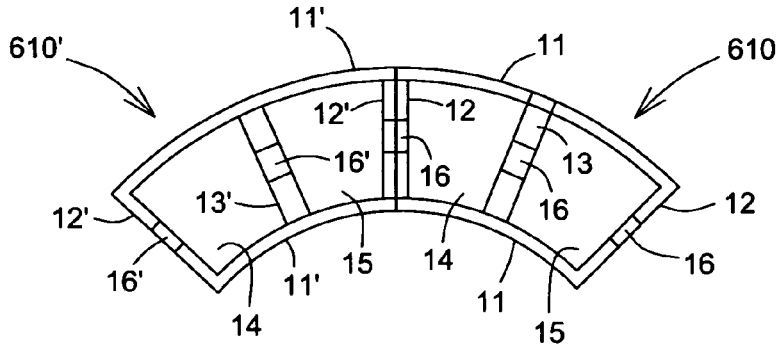
FIG. 5 (*a*) is a top plan view of two adjacent curved blocks according to an embodiment of the system of the invention.
Figure 5B:
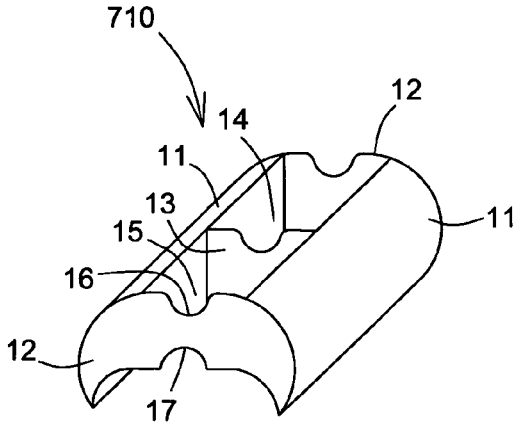
Figure 5C:
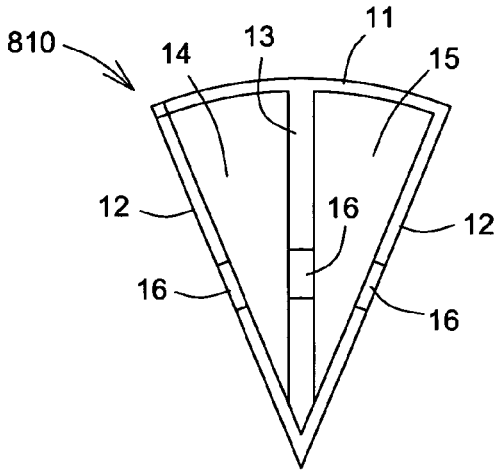
Figure 5D:
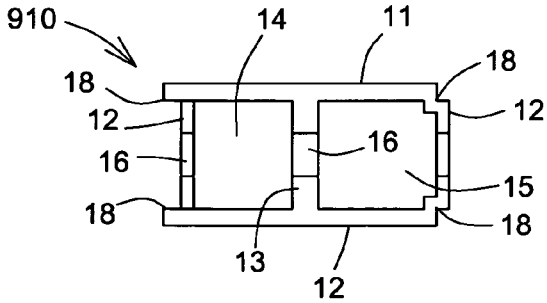

The regular block 10, best shown at FIG. 2, typically has a composite material composition using aggregates of fibers or like fillers in a matrix of cement or polymer, as directed by the contemplated application and desired mechanical, thermal and structural properties. Block 10 comprises two side walls 11 and two parallel end walls 12, the outer length of the side walls 11 being twice the outer length of the end walls 12. A cross member 13 is provided at the centre of the block 10 to enable assembly of blocks in a vertically interlocked manner, as shown in FIG. 1, while also improving the structural strength of the blocks. Regular block 10 is hollow, having neither top nor bottom other than free edges of walls 11, 12 and cross member 13 which defines through cavities 14 and 15. It is also worth pointing out that end walls have a thickness $\epsilon$ while cross member 13 has twice that thickness, that is $2\epsilon$, for reasons that will become evident upon reading of the following. Block 10 further comprises a semi-circular cut-out 16 at the top end of each end wall 12 and cross member 13 and, symmetrically comprises a second set of reversed semi-circular cut-outs 17 at the base end of end walls 12 and cross member 13. However, it may be found desirable to provide blocks (not illustrated) which do not have base end cut-outs such as 17 to serve as base blocks usable for laying down the first course of a wall for example. Cut-outs 16 are located in vertical alignment with cut-outs 17, and preferably at the centre of end walls 12 and cross member 13 to ensure reversibility of the blocks and facilitate handling.

Top and base cut-outs 16 and 17 are key features of the system 1 as they co-operate to form a longitudinal circular passage throughout the blocks 10, 10', when blocks are superimposed in vertically interlocked courses. For example, in use, a base semi-circular cut-out 17 of a wall 12 is aligned just above a top semi-circular cut-out 16 of a cross member 13 of a block 10 of the course just below to form a circular opening. Reciprocally, cut-outs 17 at the base of cross members 13 align above cut-outs 16 at the top of end walls 12 to yield a series openings in line in the vertical and longitudinal axis of the courses. Cut-outs 16, 17 of adjacent blocks such as 10 and 10' in a given course (see FIG. 1) also register so that openings form with cavities 14 and 15 a straight longitudinal passage through a given course.

Now, referring to FIGS. 1, 3 and 4, connector 50 of the block and connector system 1 will be described in detail. FIG. 1 shows that connector 50 has a spool shape and comprises a cylindrical body 51 provided with rims or flanges 52 at each end thereof. The cylindrical body 51 defines an internal axial hole 53 throughout the connector 50. The axial spacing between the two rims or flanges 52 is substantially equal to the thickness of cross members 13, that is twice the thickness $\epsilon$ of end walls 12. Also, the outer diameter of the body 51 is substantially equal to the diameter of cut-outs 16 and 17. Indeed, as shown in FIG. 1, the connector 50 first serves the purpose of connecting two adjacent end walls 12, 12', the inner face of each flange 52 abutting against the inner face of the walls to firmly connect them together preventing relative movement of blocks 10 and 10' in the longitudinal and transversal axis. Secondly, the upper half of the spool-like connector 50 engages in a base cut-out 17 of a cross member 13 of a block 10 to be superimposed, thereby also locking that block firmly in both longitudinal and transversal directions.

The spacing between flanges 52 may be slightly tapering in the direction of the body 51 to facilitate insertion in cut-outs 16 and 17 while applying a slight bias pressure urging walls 12 and 12' against each other. To help performing this task, connector 50 is preferably made from a compliant and/or resilient material. Thermoplastic materials such as polypropylene, polyethylene and ABS are contemplated as good selections for their resilience and low production cost by injection molding. One may also consider using a high tensile strength metallic core covered (i.e. by dipping) with a layer of elastomeric material such as polyurethane.

Cut-outs 16 and 17 may reciprocally be slightly larger than the diameter of the body 51 at their open end to facilitate insertion of the body therein while thereafter converging to the size of the body to prevent excessive play between the body and the cut-out.

Although FIGS. 1 and 3(*a*) show connector 50 provided with a circular body 51 provided with full circular rims 52, one with ordinary skill in the art will easily appreciate that the contemplated use of connector 50 may as well be performed with any structure comprising a cylindrical hollow body, terminated by at least one upper flange and one lower flange at each end thereof, which would still provide a cross sectional view as illustrated in FIG. 3(*b*). For example, FIG. 3(*c*) shows a side view of a connector 50 with a still circular body 51 but with only upper and lower rim portions (flanges) 52. FIG. 3(*d*) shows a connector 50 comprising a body 51 with a square cross section and full square rims 52. In FIG. 3(*e*), the connector 50 has a rectangular cross section body 51 provided with upper and lower flanges 52. Obviously, the rim 52 at each end of the body may be split in more than two portions (flanges) distributed around the perimeter of the body 51. Although varying the shape of the rims or flanges 52 has no incidence on the shape of the cut-outs 16 and 17, should the body 51 have a cross section other than circular, cut-outs would then have to be provided with a matching shape and size to still enable snug engaging of the mating portions. Thereby, while flanges 52 prevent relative axial movement of the bocks 10, 10', the body 51 prevents movement in a transversal horizontal direction.

In order to enable erection of structures such as walls, it is desirable to provide blocks with a different distribution of top and base cut-outs 16 and 17, so that corners, wall ends and wall intersections may be realized. Accordingly, different types of specialized parallelepiped shaped blocks are schematically illustrated (wall thicknesses not detailed) at FIGS. 4(*a*)-4(*e*), but types are not meant to be limited thereto. A corner block 110, as illustrated in FIG. 4(*a*) is characterized by the fact that it is provided with an additional set of cut-outs 16, 17, on one side wall 11 in order to enable connection of a block at right angle to make a corner of a structure. Right or left turns may be done by merely flipping the block 110 upside down. If the block is a base block with no base cut-outs 17, as previously described, than reversibility is prevented and right and left corner base blocks should be provided, with top end cut-outs provided in the right wall or left side wall respectively. Cut-outs in the outer end wall may be omitted (FIG. 4(*a*)) to present a closed (blind) external surface, or may be provided (110' in FIG. 1) to enable a second wall segment to be connected thereto to form a T-like end structure. A "T" end block 210 as illustrated in FIG. 4(*b*), characterized by cut-outs 16, 17 in both side walls 11 and no cut-out in the adjacent end wall 12, may also be provided. An "X" block 310 as illustrated in FIG. 4(*c*) may be used to create a crossing between two intersecting wall portions. Block 310 is thus characterized by the presence of sets of cut-outs 16, 17 in both side walls 11 and in both end walls 12. As shown at FIGS. 4(*d*) and 4(*e*) respectively, full size and half size blind end blocks 410 and 510 may further be provided to terminate a wall section that does not connect to any intersecting block structure. Therefore, these blind end blocks are characterized by the presence of a set of cut-outs 16, 17 in only one end wall 12, and absence of cut-outs in side walls 11.

In every parallelepipedic block configuration, cut-outs 16, 17 in parallel walls are always aligned on an axis to enable creation of continuous longitudinal passages in erected walls. Since connectors 50 always comprise an axial hole 53, their presence in the erected wall only slightly reduces the size of the passages at connection points, but leaves much enough space to pass piping, cables or like services, or to create a continuous lattice by passing rods and pouring cement in cavities 14, 15 or injecting an insulating material.

FIG. 5 shows further block shapes destined to special architectural applications or landscaping, while still comprising the connecting structure of the previously described embodiments of the block and connector system of the present invention. In FIG. 5(*a*) there are shown regular blocks 610 and 610' having side walls 11 curved about a vertical axis to constitute segments of circular or otherwise curved structures. FIG. 5(*b*) shows a decorative regular block 710 characterized by side walls 11 curved about a longitudinal axis. FIG. 5(*c*) shows an example of a block 810 having two non-parallel connecting end walls 12, and only one curved side wall 11. In FIG. 5(*d*) there is shown a block 910, according to a further embodiment, wherein special vertical edges 18 are created at lateral ends of end walls 12 to improve sealing at block joints.

One can thus appreciate that the building block and connector system of the present invention, advantageously provides stiff and tight interconnections between blocks in the axial and transversal directions of the courses, while still providing vertical and horizontal passages within the erected structure to serve a plurality of important uses. The block structure enables vertically interlocked assembly, prevents excessive weight and molding complexity and may prevent infiltrations, limits thermal conductivity, may be produced at low cost and is not likely to be critically affected by rough handling and adverse site conditions such as dirt.

It should be appreciated that the invention is not limited to the particular embodiments described and illustrated but includes all modifications and variations falling within the scope of the invention as defined in the appended claims.

What is claimed is:

1. A building system comprising:

i) at least first, second, and third hollow blocks each having at least one side wall, and at least two end walls extending in at least one common direction, at least one of the walls in each block having a given wall thickness and being provided with at least a respective first cut-out extending completely throughout said given wall thickness at a first free end of said wall, said third block further comprising a centre cross member extending parallel to the end walls and having a member thickness twice the given wall thickness, said cross member defining two opposite free ends and being provided with a respective cut-out at one or both free ends thereof, said cut-out of said third block being identical in perimeter to said cut-outs of said first and second blocks; and ii) at least one connector element defining a hollow body having a shape and size conforming with a perimeter corresponding to a juxtaposition of said cut-outs of any two of said blocks for snug engagement within the perimeter, and at least one first flange projecting from a first end of the body and at least one second flange projecting from a second end of the body, said first and second flanges defining an intermediate spacing substantially equal to twice said given wall thickness, said first, second, and third blocks being connectable to one another for erecting structures by registering cut-outs of adjacent walls of said first and second blocks against each other and connecting said adjacent walls thereof together by snugly positioning the connector element in the cut-outs thereof with the first and second flanges abutting respectively on respective inner faces of each of the adjacent walls, thereby forming a first level from said first and second blocks with the connector element extending completely through the adjacent walls which are held between the first and second flanges, and by snugly positioning the cut-out of the cross member within the connector element with the first and second flanges abutting on opposing faces of the cross member, the third block thereby forming a second level connected to said first level with the opposing faces extending adjacently alongside said respective inner faces between the first and second flanges and the connector element extending completely through the cross member and walls at said cut-outs, the first and second flanges thereby preventing longitudinal movement of first ,second, and third blocks along an axis defined by said connector element.

2. A building system as defined in claim 1, wherein a said at least one wall is further provided with a respective second cut-out at a second opposite free end thereof.

3. A building system as defined in claim 2, wherein said at least one wall comprises at least one end wall.

4. A building system as defined in claim 2, wherein said at least one wall comprises two end walls.

5. A building system as defined in claim 1, wherein each cut-out defines a semi-circular wall opening and the body defines a circular cross section.

6. A building system as defined in claim 1, wherein each cut-out defines a rectangular wall opening and the body defines a rectangular cross section.

7. A building system as defined in claim 1, wherein the body defines a circular cross section and the first and second flanges define a ring shape centered on the longitudinal axis of the body and orthogonal to said axis, defining an axial hole through the connector.

8. A building system as defined in claim 1, wherein the body defines a rectangular cross-section and the flanges defining a H shaped connector longitudinal cross section comprise distinct upper and lower flanges.

9. A building system as defined in claim 1, wherein the intermediate spacing is tapering toward the body.

10. A building system as defined in claim 1, wherein the connector element comprises a compliant material.

11. A building system as defined in claim 1, wherein each block comprises two parallel end walls, each wall defining two opposed free ends, at least one of which being provided with a cut-out.

12. A building system as defined in claim 1, wherein each block comprises two parallel end walls and two parallel side walls twice as long as the end walls forming a rectangular parallelepiped.

13. A building system as defined in claim 1, further comprising at least a fourth block, said fourth block having at least one side wall, and at least two end walls extending in at least one common direction, at least one of the walls in said fourth block having said given wall thickness and being provided with at least one respective said cut-out extending throughout said wall thickness at a first free end of said fourth wall, said blocks being further connectable by registering cut-outs of adjacent walls of said first and second blocks against each other and connecting said adjacent walls together thereof by snugly positioning the connecter element in the cut-outs thereof with the first and second flanges abutting respectively on inner faces of each of the adjacent walls, thereby forming a first level from said first and second blocks, and by registering cut-outs of respective adjacent walls of third and fourth blocks against each other and connecting said adjacent walls thereof together by snugly positioning the cut-outs thereof in the connector element adjacent the cut-outs of the first and second blocks with the first and second flanges abutting respectively on inner faces of each of the adjacent walls of said third and fourth blocks, thereby forming said second level from the third and fourth blocks.

14. A building system as defined in claim 1, wherein at least one block comprises two parallel end walls and two parallel side walls twice the length of said end walls forming a rectangular parallelepiped and further comprising an inner cross member parallel to the end walls, a cut-out being provided at both free ends of one of the end walls, at both free ends of the cross member and at both free ends of one of the side walls, to define a end block.

15. A building system as defined in claim 14, wherein at least one block is further provided with a pair of cut-outs on the second side wall, facing those of the other side wall to define a T end block.

16. A building system as defined in claim 15, wherein at least one block is further be provided with a cut-out at both free ends of the second end wall to define a crossing X block.

17. A building block as defined in claim 1, wherein at least one block comprises two parallel end walls and two parallel side walls of equal length defining a hollow cube, one end wall being provided with cut-outs at both free ends thereof to define a half end block.

18. A building system as defined in claim 1, wherein at least one block comprises two concentric arc shaped side walls, two radially extending end walls and a radially extending center cross-member.

19. A building system as defined in claim 1, wherein at least one block comprises one arc shaped side wall, two intersecting radially extending side walls and a radially extending center cross member.

20. A building system as defined in claim 1, wherein at least one block further comprises upright and/or longitudinal sealing edges.

* * * * *